United States Patent [19]

Dunn

[11] 4,106,815

[45] Aug. 15, 1978

[54] MINING MACHINES

[75] Inventor: Eric James Dunn, Retford, England

[73] Assignee: Dosco Overseas Engineering Limited, England

[21] Appl. No.: 739,095

[22] Filed: Nov. 5, 1976

[30] Foreign Application Priority Data

Nov. 18, 1975 [GB] United Kingdom ..... 47440/75

[51] Int. Cl.[2] ..... E21C 25/06

[52] U.S. Cl. ..... 299/59; 299/12; 299/64; 299/71; 299/90

[58] Field of Search ..... 299/59, 64, 71, 75, 299/89, 90; 70/245, 251

[56] References Cited

U.S. PATENT DOCUMENTS

| | | | |
|---|---|---|---|
| 2,795,408 | 6/1957 | Goodrich | 299/1 X |
| 3,013,784 | 12/1961 | Osgood | 299/90 X |
| 3,288,532 | 11/1966 | Carver | 299/90 |
| 3,489,461 | 1/1970 | Lauber | 299/1 |
| 3,590,612 | 7/1971 | Henning | 70/251 |
| 3,618,724 | 11/1971 | Oehl et al. | 192/53 F |
| 3,917,021 | 11/1975 | Williams et al. | 70/245 |
| 3,966,257 | 6/1976 | Shah | 299/64 |

*Primary Examiner*—Ernest R. Purser
*Assistant Examiner*—William F. Pate, III

[57] ABSTRACT

A mining machine adapted to be driven forwardly towards a working face comprises one or more cutting booms projecting forwardly from the machine, a cutting tool mounted on the forward end of the or each boom, and a drive mechanism for rotating the cutting tool relative to the boom, the said mechanism including a multi-speed gearbox whereby the cutting tool may be selectively driven at two or more different cutting speeds.

4 Claims, 4 Drawing Figures

MINING MACHINES

The foregoing abstract is neither intended to define the invention disclosed in the specification, nor is it intended to be limiting as to the scope of the invention in any way.

BACKGROUND OF THE INVENTION

The present invention relates to mining machines.

Conventional mining machines include a boom which projects forwardly from the machine and which carries a rotatable cutting head at its free end. The cutting head may be arranged to rotate about an axis parallel or perpendicular to the axis of the boom.

The efficiency with which the cutting head removes material from a working face is determind in part by the rate of rotation of the head. In soft materials, such as coal, the optimum cutting efficiency is obtained using a relatively high rate of rotation. In harder materials, for example some metal ores, a lower rate of rotation is more effective.

Some materials, for example iron ore, occur in deposits which contain two different types of material of different hardnesses. Since conventional mining machines having boom-mounted cutting heads can only be operated at a single cutting speed, the conventional machines cannot be used to work deposits of materials of differing hardnesses with optimum efficiency.

Accordingly, it is the primary object of the invention to provide a mining machine which can be used to excavate materials of different hardness at optimum efficiency.

SUMMARY OF THE INVENTION

According to the present invention there is provided a mining machine which may be driven forwardly towards a working face and comprising a boom projecting forwardly from the machine, a cutting head mounted on the forward end of the boom and a drive mechanism for rotating the cutting head relative to the boom, the said mechanism including a multi-speed gearbox whereby the cutting head may be selectively driven at two or more different cutting speeds.

Although the gearbox may be capable of selecting three or even more different cutting speeds, in practice, a two-speed gearbox will be sufficient for most purposes.

Preferably, the cutting head is rotatable about the axis of the boom. Other types of cutting head may however be used, for example a drum-type cutting head in which the head is rotatable about an axis perpendicular to the axis of the boom.

The boom itself is preferably mounted on the machine for movement about vertical and horizontal axes and conveniently, the gearbox is incorporated within the boom. Thus, where the cutting head is rotatable about the axis of the boom, the gearbox preferably includes input and output shafts which are coaxial with the boom.

In general the gearbox will be operable by a gear selector lever and, desirably, a safety device is incorporated in the machine in order to prevent a change of gear from being made whilst the cutting head is in use. Thus, in a preferred embodiment of the invention the gear selector lever may be locked in each of its operating positions by a key, and the cutting head is driven by a motor which cannot operate unless the same key is engaged in a lock for the motor.

A preferred mining machine in accordance with the invention will now be described, by way of example only, with reference to the accompanying drawings in which.

Figure 1:
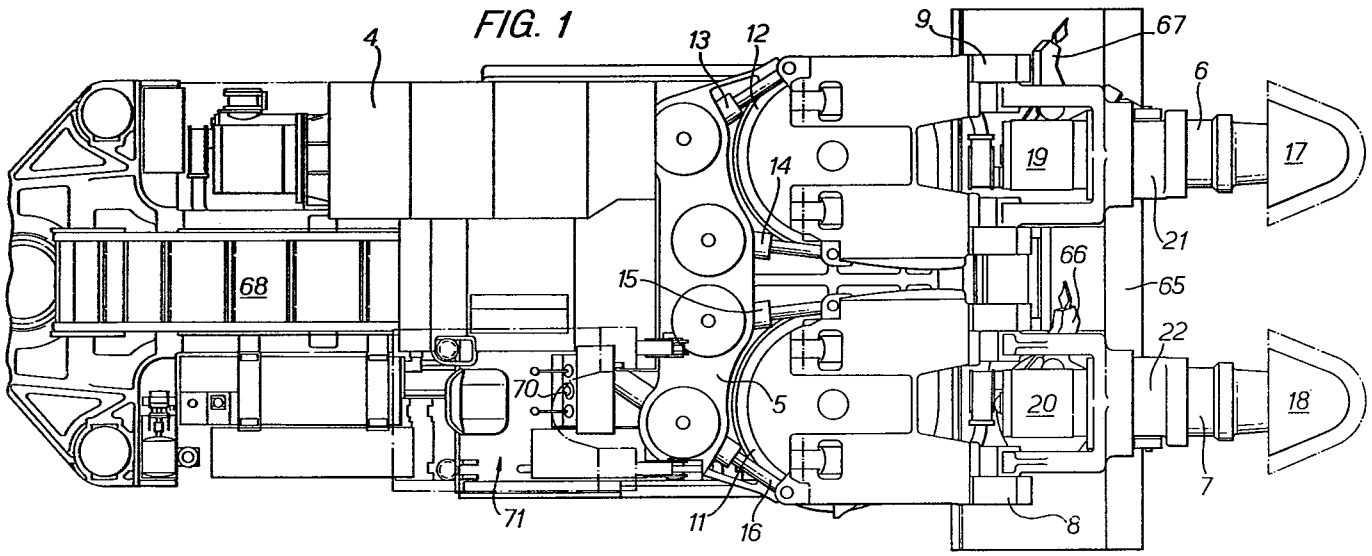
FIG. 1 is a plan of the mining machine.
Figure 2:
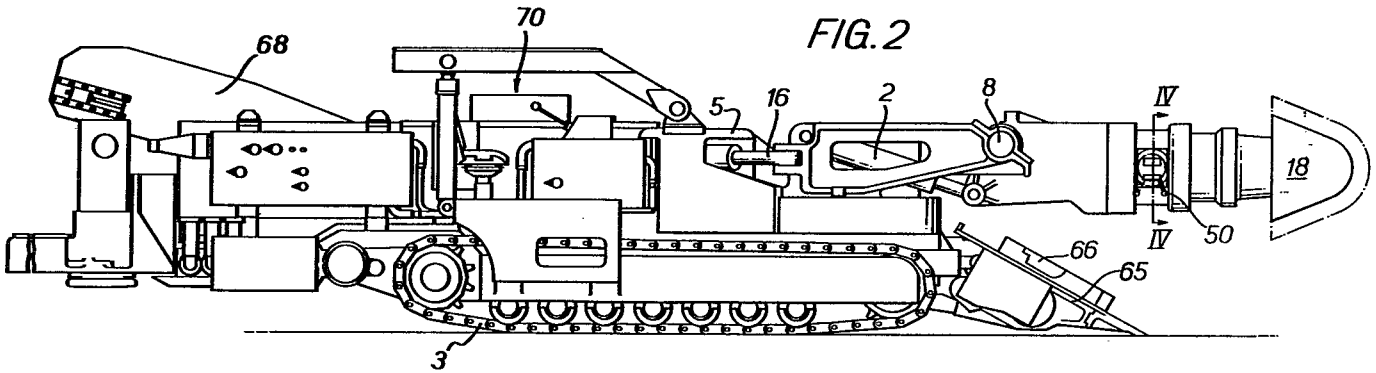
FIG. 2 is a side elevation of the machine of FIG. 1.

Referring to FIGS. 1 and 2, the mining machine may be driven forwardly on two crawler tracks, one of which is shown at 3 in FIG. 1, which are powered from a power pack 4 mounted on the rear of the machine. Towards the forward end of the machine is a turret 5 in which are mounted a pair of cutting tools. Each cutting tool comprises a boom 6, 7 which is mounted in bearings 8, 9 for pivotable movement about a horizontal axis by means of hydraulic cylinders 2. The bearings 8, 9 are themselves mounted in slewing rings 11, 12 so that the booms may also be pivoted about vertical axes by means of further hydraulic cylinders 13, 14, 15, 16.

A cutting head 17, 18 is mounted on the forward end of each boom 6, 7. Each cutting head is rotatable about the axis of its respective boom and is driven by a respective drive mechanism which includes an electric motor 19, 20 mounted in the rearward part of each boom 6, 7.

An apron 65 is mounted immediately beneath the booms 6, 7 for gathering material from the floor of a mined cavity immediately in front of the machine. Two gathering devices 66, 67 are mounted towards each side of the apron 65 and direct material on the apron 65 towards a central position. A longitudinal chain conveyor 68 mounted centrally in the machine removes material from this central position on the apron 65 and directs it to the rear of the machine.

The operation of the crawler tracks 3, booms 6, 7, cutting heads 17, 18, gathering devices 66, 67 and conveyor 68 are all controlled in a conventional manner from a control station 70 situated centrally and to one side of the machine. The movement of each cutting head is controlled by a respective control lever 31, 32.

Figure 3:
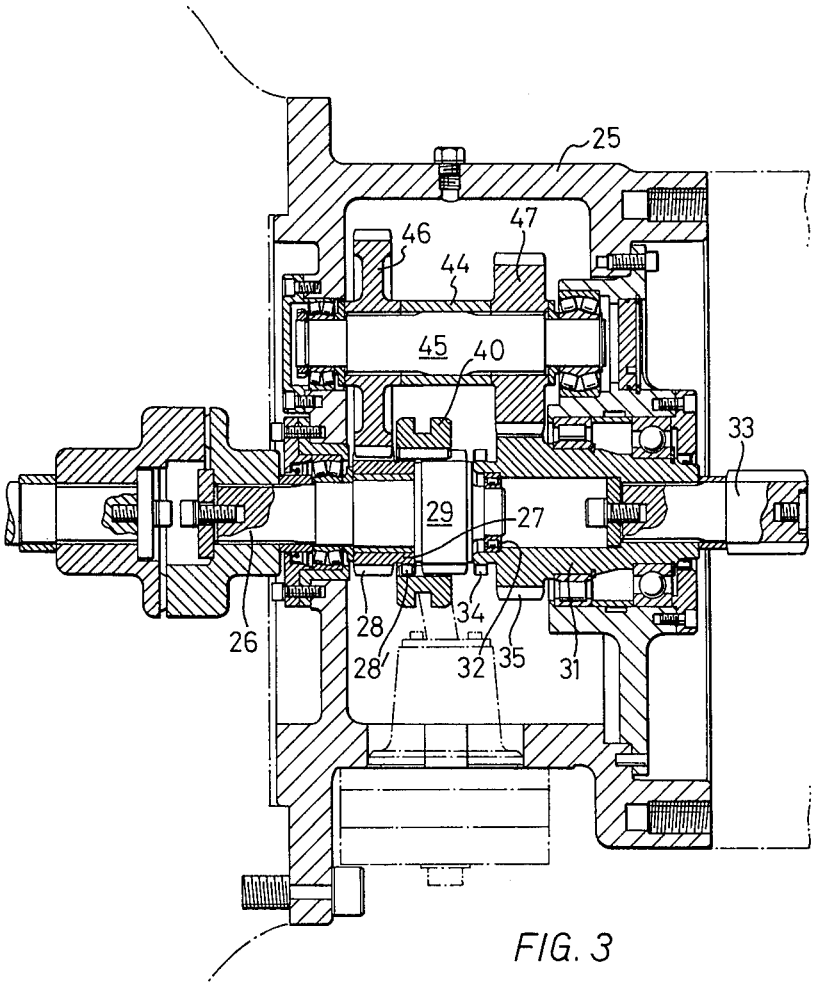
FIG. 3 is a longitudinal cross-section through one of the booms of the mining machine of FIGS. 1 and 2 illustrating the gearbox thereof and FIG. 4 is a further cross-section through part of one of the booms of the machine of FIGS. 1 and 2 taken along line IV—IV of FIG. 2.

The drive from each of the electric motors 19, 20 is transmitted to the respective cutting head 17, 18 through respective two-speed gearboxes 21, 22 mounted in respective ones of the booms 6, 7. The gearboxes are identical in construction, and the construction of one of the gearboxes is illustrated in FIG. 3.

An input shaft 26 of the gearbox is coupled to a respective one of the electric motors 19, 20 and extends coaxially with the boom into the cylindrical housing 25 of the gearbox. A first pinion 27 is freely rotatable on the input shaft and is provided with first and second rings of gear teeth 28, 28′ of similar diameter. A second pinion 29 is secured to the end of the input shaft 26 adjacent the first pinion 27 and is provided with teeth of the same pitch as those of the second ring of teeth 28′ on the first pinion 27.

The free end of the input shaft 26 is rotatably mounted in bearings in a recess in one end 32 of a third pinion 31 which is splined onto an output shaft 33 of the gearbox, which is coupled to the respective one of the cutting heads 17, 18 on the respective boom. The third pinion is provided with two rings of gear teeth 34, 35, one of which, 34, is of smaller diameter than the other, 35, and has teeth of the same pitch as those of the second pinion 29. The other ring of teeth 35 is of larger diameter than the rings of teeth on the second pinion 29.

An internally-toothed coupling ring 40 is slidable axially along the second pinion between two operating positions. In the first position, illustrated in FIG. 3, the coupling ring simultaneously engages the second pinion 29 and the second ring of teeth 28' on the first pinion 27. In the second position, the coupling ring simultaneously engages the second pinion 29 and the smaller diameter ring of teeth 34 on the third pinion 31.

A gear shaft 45 is rotatably mounted in the housing 25 parallel with the input and output shafts 26, 33 and carries two intermediate gears 46, 47 and a spacer sleeve 44, all of which are splined to the shaft 45. The intermediate gears are of different diameters and respectively engage the first ring of teeth 28 on the first pinion and the larger-diameter ring of teeth 35 on the third pinion 31.

When the coupling ring 40 is in its first position therefore, the drive to the input shaft 26 is transferred by the coupling ring 40 to the first pinion 29 and thence to the third pinion 31 via the intermediate gears 46, 47. The output shaft 33 is therefore rotated at a lower rate than the input shaft 26. When the coupling ring 40 is in its second position, a direct connection is established between the input and output shafts.

Figure 4:
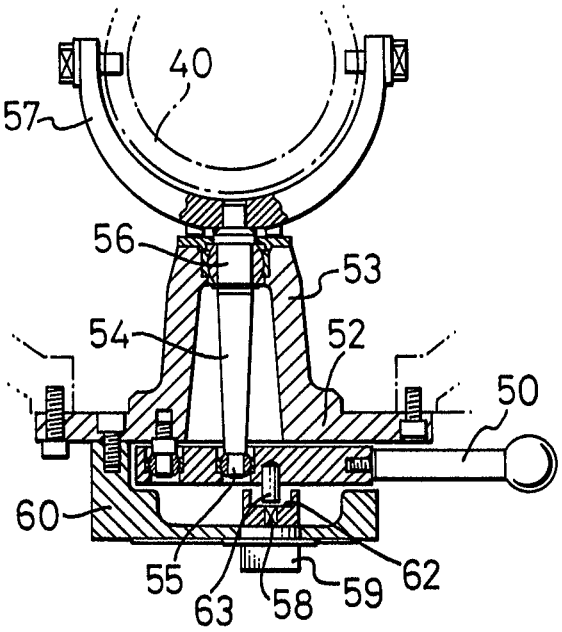

Each coupling ring may be moved between its two operating positions by a selector mechanism one of which is illustrated in detail in FIG. 4. Referring to FIG. 4, the selector mechanism comprises a gear selector lever 50 pivotally mounted on a base plate 52 which is bolted to the boom 7 of the mining machine adjacent the two-speed gearbox 22. The plate 22 carries a bushing 53 which extends radially into the gearbox 22. An operating lever 54 is pivotally connected at one end 55, to the gear selector lever 50, and is pivotably mounted towards its other end 56 in the internal end of the bushing 53. A yoke 57 is mounted on the other end of the lever 54 and engages with the coupling ring 40. Pivotal movement of the lever 50 between the positions shown in full and broken lines in FIG. 2 therefore causes the coupling ring 40 to move between its two operating positions.

The gear selector lever is provided with a safety device to prevent a gear change from being made whilst the cutting head is being rotated. This device comprises a lock 58 which is rotatable by a key 59 in a cover plate 60 which overlies the lever 50. The key 59 can only be removed from the lock 58 when the lock is in its locked position.

The lock 58 includes a channel 62 which cooperates with a pin 63 on the lever 50. In the unlocked position, illustrated in FIG. 4, the pin 63 can pass freely along the channel allowing a different gear to be selected in the gearbox. When the lock 58 is rotated through 90° however the pin can no longer pass along the channel 63 and the lever 50 is therefore retained in one or other of its operation positions.

The key 59, which can only be removed from the lock 58 when locked, also operates a lock 70 (see FIG. 1) for the drive motor of the cutting head, the drive motor being inoperable unless the key is engaged in the motor lock. As a result it is impossible to move the gear selector lever 50 whilst the motor is running.

If separate locks are provided for each motor 19, 20, separate dissimilar keys can be used for each of the cutting tools. When, as illustrated in the drawings, both motors 19, 20, are operated from a single control, a single key can be used for both cutting tools.

In use, the machine is advanced to a working face under the control of the operator in the control station 71. If the material being mined is relatively soft, the gearboxes 21, 22 are arranged to transmit a direct drive to the cutting heads 17, 18 from the motors 19, 20.

With the cutting heads 17, 18 rotating, the machine is advanced further towards the working face so that the cutting heads 17, 18 bore into the face. Using the control levers 31, 32 the operator causes the cutting heads 17, 18 to traverse the working face in regular sweeps.

When sufficient material within reach of the cutting heads has been removed from the face, the cutting heads are deactuated. The gathering devices 65, 66 and the conveyor 68 are then actuated and the machine is advanced towards the newly excavated cavity. The miner material passes onto the apron 65 and is directed to the rear of the machine on the conveyor 68 for disposal.

The sequence of operations is then repeated. If at any time during the mining process the machine encounters harder material, the operator switches off the motors 19, 20 with the key 59 and removes the key from the motor lock. The operator then dismounts, inserts the key 59 into each of the gearbox locks 58 and moves the levers 50 to select the reduced speeds in the gearboxes 21, 22. He then removes the key 59 from the locks 58, thereby locking the gearboxes, returns to the control station 30 and reactuates the motors 19, 20 with the key 59. The machine can then continue cutting on the harder material with the cutting heads running at a lower speed.

The cutting tool of the mining machine described above is therefore capable of operating at two different mining speeds and can be used with optimum cutting efficiency in both hard and soft materials. It will be appreciated that, although the machine described includes two cutting tools, the present invention is equally well applicable to mining machines with a single cutting tool.

I claim:

1. A mining machine comprising a body, means for driving the body forwardly towards a working face, a boom projecting forwardly from said body, a cutting tool mounted on the forward end of the boom, means for moving said boom relative to said body to effect transversing of a working face by said cutting tool, a drive mechanism for rotating the cutting tool relative to the boom, and said drive mechanism includes a multi-speed gearbox for selectively driving the cutting tool at two or more different cutting speeds, said gearbox including a gear selector lever movable between operating positions corresponding to respective ones of the cutting speeds of said gearbox, means for locking the gear selector lever in each of the operating positions, and a key for operating the locking means, and the drive mechanism for the cutting tool includes a motor and a lock, the motor being inoperable unless the said key is engaged in the lock.

2. A mining machine according to claim 1 wherein the gearbox is incorporated in the boom.

3. A mining machine according to claim 1 wherein said drive mechanism is incorporated in said boom.

4. A mining machine according to claim 3 wherein said drive mechanism includes a self-contained motor.

* * * * *